US006786472B1

(12) United States Patent
Dahl

(10) Patent No.: US 6,786,472 B1
(45) Date of Patent: Sep. 7, 2004

(54) PANEL REMOVAL TOOL

(76) Inventor: Elroy W. Dahl, N. 6510 Hideaway Rd., Black River Falls, WI (US) 54615

( * ) Notice: Subject to any disclaimer, the term of this patent is extended or adjusted under 35 U.S.C. 154(b) by 0 days.

(21) Appl. No.: 10/459,141

(22) Filed: Jun. 10, 2003

Related U.S. Application Data

(60) Provisional application No. 60/389,240, filed on Jun. 14, 2002.

(51) Int. Cl.[7] ..... B25C 11/00
(52) U.S. Cl. ..... 254/25
(58) Field of Search ..... 254/25, 21, 131, 254/131.5; 81/45, 46; 30/169

(56) References Cited

U.S. PATENT DOCUMENTS

| | | | | |
|---|---|---|---|---|
| 3,467,405 | A | | 9/1969 | Fogg |
| 3,587,121 | A | | 6/1971 | Morrow |
| 3,836,119 | A | | 9/1974 | Saucier, Sr. et al. |
| 4,745,651 | A | | 5/1988 | Schellenger |
| D303,484 | S | | 9/1989 | Stanart |
| 5,005,243 | A | * | 4/1991 | Yip ..... 254/131 |
| 5,087,019 | A | | 2/1992 | Peabody et al. |
| 5,207,126 | A | | 5/1993 | Schaben |
| D352,220 | S | | 11/1994 | Schroeder |
| 5,447,289 | A | | 9/1995 | Callahan |
| 5,695,171 | A | | 12/1997 | Shine |
| D392,867 | S | | 3/1998 | Gracy et al. |
| 5,813,295 | A | | 9/1998 | Jensen, Jr. |
| D439,126 | S | | 3/2001 | Gohman |

* cited by examiner

*Primary Examiner*—Robert C. Watson
(74) *Attorney, Agent, or Firm*—Tipton L. Randall

(57) ABSTRACT

A panel removal tool for disconnecting a panel from a mounting surface is disclosed. The tool comprises a linear blade member having a portion with top and bottom surfaces and opposed, parallel edges, with each opposed edge including a V-shaped notch. The blade member includes an angled portion disposed at between 90 and 150 degrees to the linear, planar portion. A handle portion is collinearly secured to the blade member angled portion. The blade member planar portion is adapted for insertion between a panel and a mounting surface, with one of the blade V-shaped notches engaging a panel fastener. The user pivots the blade member on an opposed edge opposite the V-shaped notch engaging the panel fastener, and thereby frees the fastener from the support surface.

18 Claims, 4 Drawing Sheets

SIDE VIEW

SECTION A-A

PANEL REMOVAL TOOL

CROSS-REFERENCE TO RELATED APPLICATIONS, IF ANY

This application claims the benefit under 35 U.S.C. §119 (e) of now abandoned provisional application Ser. No. 60/389,240, filed 14 Jun., 2002. Application Ser. No. 60/389,240 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a hand tool. More particularly, the present invention relates to a hand tool used for removing panels. Most particularly, the hand tool includes a flat blade for inserting behind a panel to assist in the removal thereof.

2. Background Information

In the field of auto body repair, it is routinely required that various body panels and parts require disconnection from their point or points of attachment. The body panel or part may have been damaged and replacement is required, or the panel or part needs to be removed in order to access some other panel or part that requires repair or replacement. This removal of panels/parts is time consuming, particularly where the panels/parts removed will be reconnected to its original location, and damage to the panels/parts must be avoided.

For example, the interior door panels, ceiling panels and dashboard of automobiles are held in position by plastic or metal fasteners having large, flat heads imbedded within the panel or dash and shafts that insert into apertures in the automobile chassis or frame. The fastener shafts protrude from the side of the panel that fits against the chassis or frame, so as to present a smooth exterior surface when the panel is secured in position. Care must be taken when removing the panels or dashboard, so as not to force the imbedded fastener head from within the panel or dashboard. Thus, accessing the numerous fasteners on the back side of the panels and dashboard presents a formidable challenge.

Similarly, the various vehicle quarter panels, hoods and trunk lids are frequently secured to the vehicle frame or chassis using metal fasteners and clips. When damaged, individual exterior panels/parts are replaced by disconnecting the clips and fasteners, removing the damaged panels/parts, and fastening new panels/parts in their place. These clips and fasteners are often difficult to access and disconnect when damaged panels/parts require removal.

Some examples of tools for which patents have been granted include the following.

Fogg, in U.S. Pat. No. 3,467,405 discloses a lever dolly for moving machinery support stands having a carriage portion and a lever portion wherein, the carriage portion comprises a pair of wheels mounted on an axle and a pair of carriage plates supporter thereby. The lower carriage plate has a portion which extends beyond the upper carriage plate to act as a prying lip, and the upper carriage plate has means disposed at the end thereof for engaging support stands so that when engaging said means prevents the support stand from slipping on or falling off of the carriage portion.

In U.S. Pat. No. 3,587,121, Morrow describes a hand tool including a pry bar with interchangeable accessories to render the tool additionally useful as a ram wedge, and by similar attachments, including lobed surfaces, to effectively increase the load arm lever advantage of the tool when so used.

U.S. Pat. No. 3,836,119, by Saucier, Sr. et al., discloses a manually manipulatable tool which lends itself to practical and reliable use when the user is called upon to dislodge and systematically free and expeditiously remove composite roof covering material. The tool includes a handle having head means at the working end. A straight elongated handle is designed for standup use and can be grasped at longitudinally spaced points with both hands. The forward end is provided with a rigidly mounted blade which is firm but bendably resilient, is longitudinally bowed, has a leading rounded end fashioned into a cutting blade and has its rearward end joined to the forward end of the handle. The leading end is inserted and wedged between the roof covering material and underlying roof surface. It is forcibly shoved in a manner to cut and dislodge strips of suitable length and paves the way for lifting and removing the remaining block-like portions.

Schellenger, in U.S. Pat. No. 4,745,651, describes a multipurpose utility tool, having an elongated straight handle attached to the top surface of a concave, curved plate. The plate has a beveled cutting edge opposite the handle. The tool is effective for a variety of cutting, prying and lifting operations. The shape of the tool facilitates prying and lifting while minimizing fulcrum damage, and has a broad sharpened forward edge for cutting and gaining access to narrow locations.

In U.S. Pat. No. 5,087,019, Peabody et al. disclose a spreader apparatus composed of an elongated tube with a threaded rod there within. A medial sleeve includes a threaded bore that mates with the threaded rod. Rotation of the medial sleeve effects extension and retraction of the threaded rod relative to the tube. The tube and rod each have a V-shaped jaw member at one end. The spreader apparatus is used for spreading the rib cage of an animal subsequent to a hunting procedure.

Schaben, in U.S. Pat. No. 5,207,126, describes a generally "L" shaped tool of rigid construction that includes a first planar leg plate orthogonally mounted to a second arcuate leg plate. The first leg plate includes a first leg plate bifurcated free end defining a first leg plate notch, and the second leg plate includes a convex leg plate surface oriented in confronting relationship relative to the first leg plate free end. The second leg plate includes a second leg plate free end formed with a first medial notch and respective second and third lateral notches positioned adjacent the free end relative to opposing first and second sides of the second leg plate to provide for multiple access to various nails and the like in removal of shingles and shakes without damage to underlying felt. A modification of the invention includes a support mount for the tool of the invention.

In U.S. Pat. No. 5,447,289, Callahan discloses a pry shovel tool for wooden pallet deck board removal and similar purposes. All embodiments include a general S-shaped (in cross-section), relatively thin blade made of thin spring metal, whose forward section defines a central cutout portion sized to allow the blade to receive therein the cross member of the pallet or like and for the sections of the blade adjoining the cutout to penetrate below the board to be removed. In one employment, a permanent elongated handle is affixed to the rear portion of the blade. In a second embodiment, a wider blade and cutout are provided to accommodate wider pallet cross members, such as a 4×4 timber. A third embodiment has a blade equipped with means for manually attaching removable handles with a short-length handle, an elongated straight handle, and a handle with a 90-degree removable extension section being disclosed.

Shine, in U.S. Pat. No. 5,695,171, describes an improved pry bar tool for removing step flashing from a building during roof replacement or like service. The tool is configured to receive a nail on right and left sides and on either terminal end, at any of a number of possible nail pulling notches or grooves. The two ends are offset differently, so that a variety of pulling positions are offered. Enlarged heads for receiving hammer blows from all angles enable the tool to be tapped while maneuvering to remove a nail from the flashing. The novel tool is able to remove nails expeditiously from flashing without distorting or destroying the flashing, so that it is reusable.

In U.S. Pat. No. 5,813,295, Jensen, Jr. discloses a roofing material removal tool having a heavy weighted head pivotally affixed in an adjustable manner to an elongated handle. The head contains an incorporated fulcrum formed by an obtuse bend perpendicular to the axial center of the tool. The head has a blade edge having a plurality of spaced detents, the detent separated from each other by an angular collecting notch which terminates in a bladed apex.

Stanart, in U.S. Pat. No. Des 303,484, shows a digging tool with a curved blade.

Schroeder, in U.S. Pat. No. Des 352,220, shows a pry bar having a number of hand holds along the length thereof.

Gracy et al., in U.S. Pat. No. Des 392,867, show a multi-purpose wrecking bar with a linear handle and a flat, plate head.

Gohman, in U.S. Pat No. Des 439,126, shows a roofing material removal tool having a linear handle and a curved blade with teeth.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention, as defined by the appended claims.

SUMMARY OF THE INVENTION

The invention is directed to a panel removal tool for disconnecting a panel from a mounting surface. The tool comprises a linear blade member, having a planar portion with top and bottom surfaces and opposed, parallel edges, with each opposed edge including a V-shaped notch. The blade member includes an angled portion disposed at between 90 and 150 degrees to the linear, planar portion. A handle portion is collinearly secured to the blade member angled portion. The blade member planar portion is adapted for insertion between a panel and a mounting surface, with one of the blade's V-shaped notches engaging a panel fastener. The user pivots the blade member on an opposed edge opposite the V-shaped notch engaging the panel fastener, and thereby frees the fastener from the support surface.

DESCRIPTION OF THE EMBODIMENTS

Nomenclature

10 Panel Removal Tool
15 Blade Member
20 Planar Blade Portion
25 Blade Top Surface
30 Blade Bottom Surface
35 Opposed Edges of Planar Blade Portion
40 V-shaped Notch in Planar Blade Portion
45 Angled Blade Portion
50 Handle Portion of Tool
55 Rolled Edge of Handle Portion
60 Beveled Surface of Planar Blade Portion
65 Square End of Blade Member
70 Cylindrical Handle Portion

Construction

Figure 3:
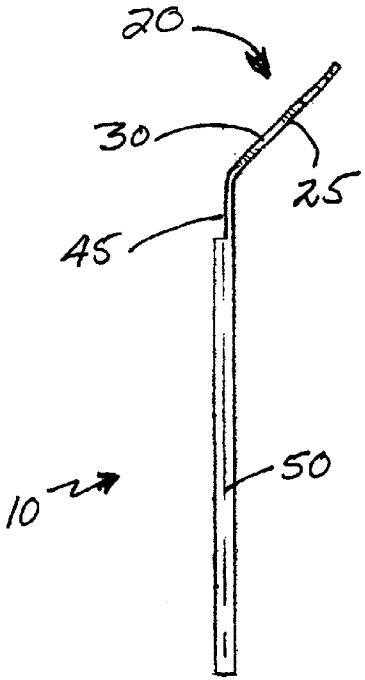
FIG. 3 is a side view of the panel tool of FIG. 1 of the present invention.
Figure 2:
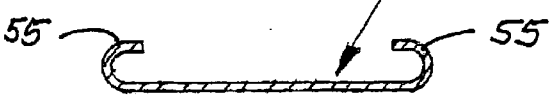
FIG. 2 is a sectional view along line A—A of FIG. 1 of the panel tool of the present invention.
Figure 1:
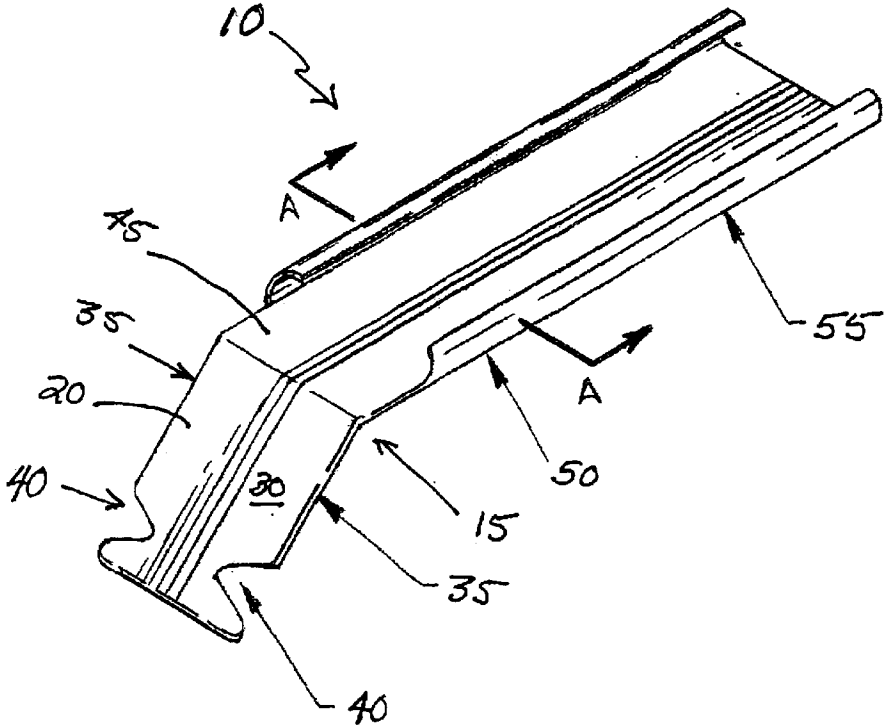
FIG. 1 is a perspective elevational view of one embodiment of the panel tool of the present invention.

Referring to FIGS. 1–3, one embodiment of the panel removal tool 10 of the present invention is shown. The tool 10 comprises a linear blade member 15, which has a planar blade portion 20 with a top surface 25 and a bottom surface 30 and opposed, parallel blade edges 35. Each opposed blade edge 35 includes a V-shaped notch 40. Preferably, the V-shaped notches 40 are directly opposed to each other and adjacent one end of the blade member 15. The blade member 15 includes an angled blade portion 45 disposed at between 90 and 150 degrees to the linear, planar blade portion 20. The embodiment of FIGS. 1–3 provides an angle of about 135 degrees between the planar blade portion 20 and the angled blade portion 45. A handle portion 50 is collinearly secured to the blade member angled portion 45. The embodiment of the tool 10 of FIGS. 1–3 includes a flat handle portion 50 with rolled edges 55, best seen in FIGS. 1 and 2. The tool 10 of the present embodiment is of unitary construction and can be formed from a single piece of sheet material. Preferably, the tool 10 is fabricated from sheet metal, such as steel alloy, for strength and durability.

In a further embodiment of the panel removal tool 10 of the present invention, the opposed, parallel edges 35 of the planar blade portion 20 each has a beveled surface 60 from the top surface 25 to the bottom surface 30, where the top surface 25 is adjacent the handle portion 50 and the bottom surface 30 is opposite the handle portion 50. Preferably, the square end 65 of the blade portion 20 has a beveled surface 60 from the top surface 25 to the bottom surface 30, as well. The edges of the V-shaped notches 40 most preferably are not beveled, but are vertical.

The blade member planar portion 20 is adapted for insertion between a panel and a mounting surface, with one of the blade V-shaped notches 40 engaging a panel fastener. The opposed edges 35 and square end 65 of the blade portion 20 each has a beveled surface 60 that facilitates insertion of the blade planar portion 20 between the panel and mounting surface, as well as positioning a panel fastener in the V-shaped notch 40 of the blade planar portion 20. The user contacts the fastener behind the panel with a beveled blade edge 35, then adjusts the tool 10 until the fastener is positioned in one of the V-shaped notches 40. The edges of the V-shaped notch 40 are not beveled, thereby providing close contact between the fastener and the blade planar portion 20. With the fastener positioned in the V-shaped notch 40, the user grasps the handle portion 50 and pivots the blade member 15 on an opposed edge 35, opposite the V-shaped notch 40 engaging the panel fastener, and thereby frees the fastener from the support surface.

Figure 4:
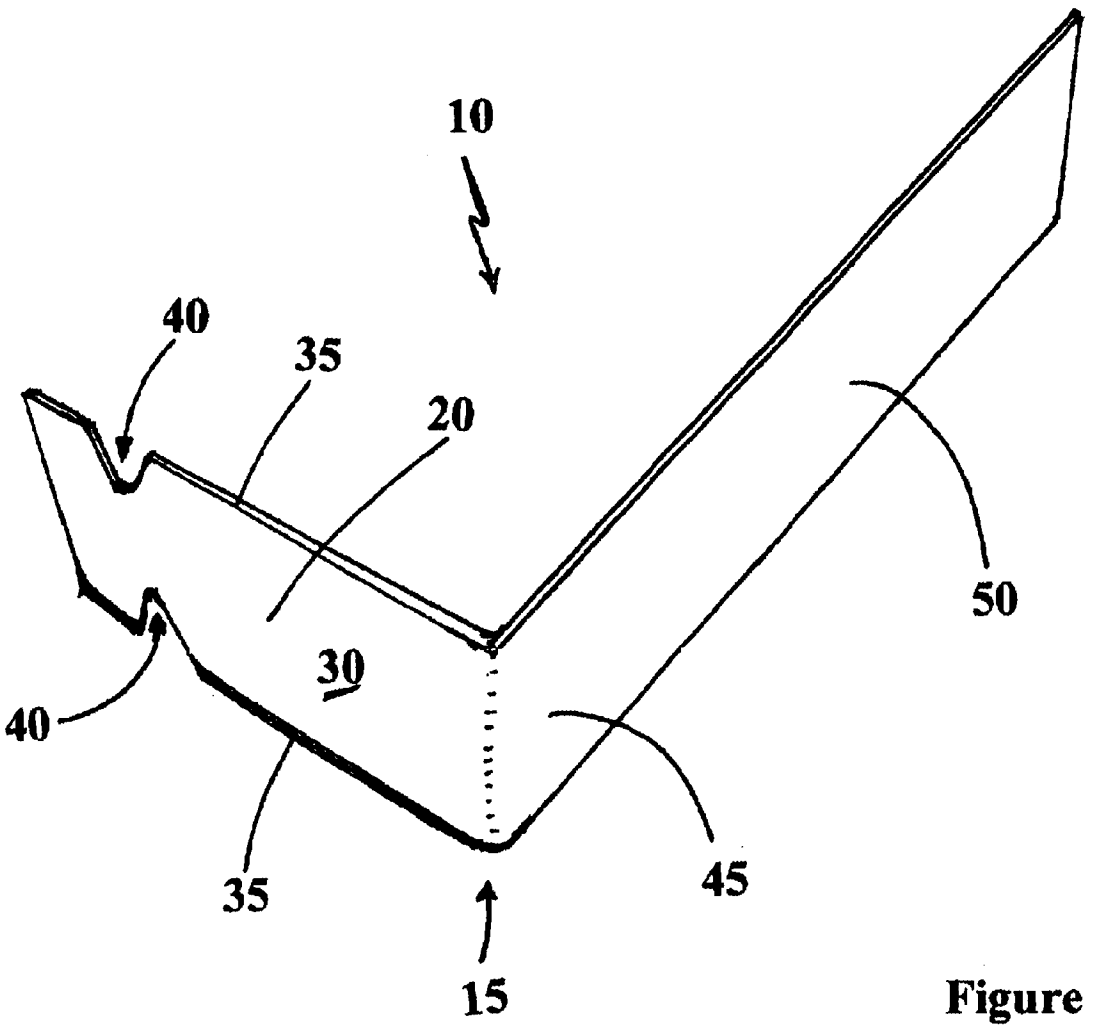
FIG. 4 is a perspective elevational view of another embodiment of the panel tool of the present invention.
Figure 5:
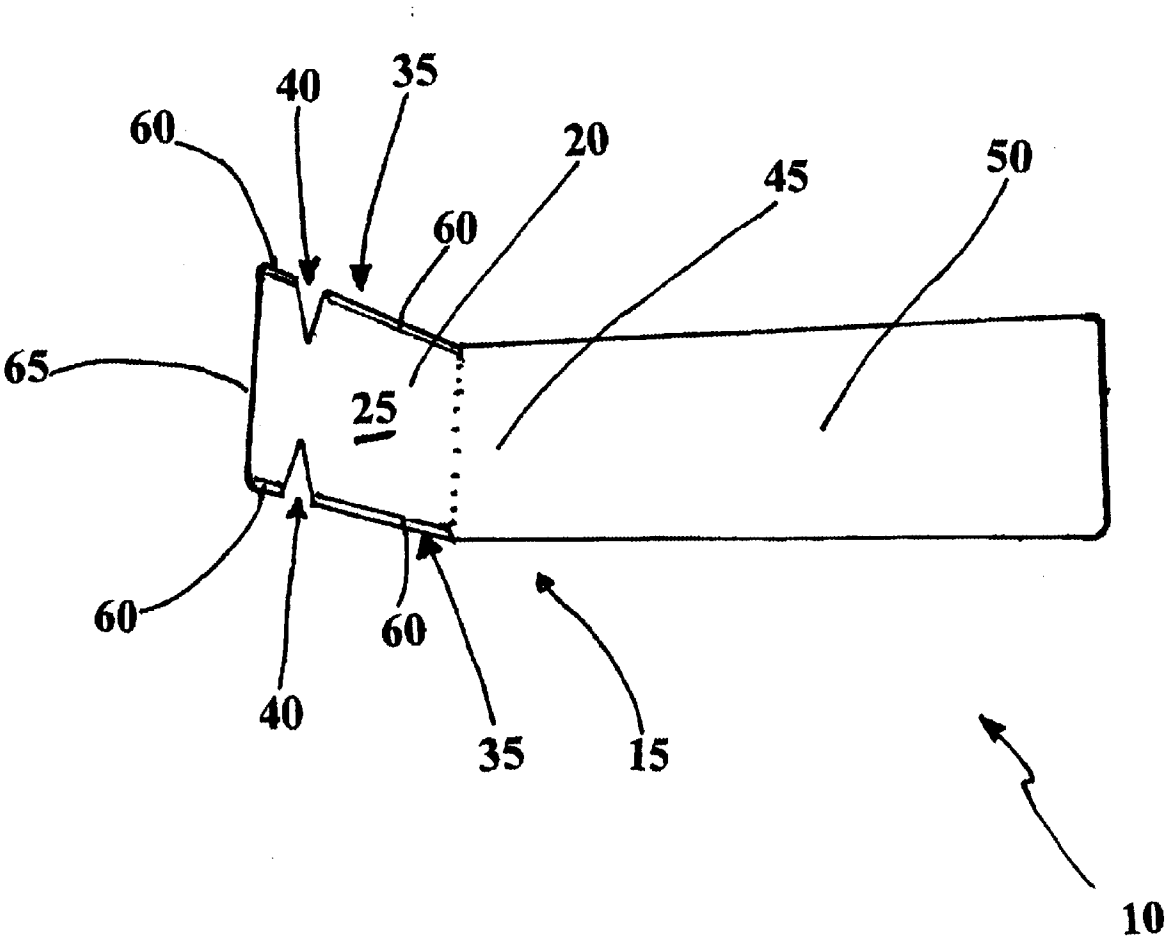
FIG. 5 is another perspective elevational view of the embodiment of FIG. 4 of the panel tool of the present invention.

Referring to FIGS. 4 and 5, another embodiment of the panel removal tool 10 of the present invention is shown. The tool 10 comprises a linear blade member 15, having a planar blade portion 20 with a top surface 25 and a bottom surface 30 and opposed, parallel blade edges 35. Each opposed blade edge 35 includes a V-shaped notch 40. Preferably, the V-shaped notches 40 are directly opposed to each other and adjacent one end of the blade member 15. The blade member 15 includes an angled blade portion 45 disposed at between 90 and 150 degrees to the linear, planar blade portion 20. This embodiment provides an angle of 90 degrees between the planar blade portion 20 and the angled blade portion 45. A handle portion 50 is collinearly secured to the blade member angled portion 45. The embodiment of the tool 10 of FIGS. 4 and 5 includes a flat handle portion 50 that is continuous with the angled blade portion 45. The tool 10 of the present embodiment is of unitary construction and can be formed from a single piece of sheet material. Preferably the tool 10 is fabricated from sheet metal, such as steel alloy, for strength and durability.

In a further embodiment of the panel removal tool 10 of the present invention, the opposed edges 35 and square end 65 of the planar blade portion 20 each has a beveled surface 60 from the top surface 25 to the bottom surface 30, where the top surface 25 is adjacent the handle portion 50 and the bottom surface is opposite the handle portion 50. The edges of the V-shaped notches 40, most preferably, are not beveled, but are vertical.

The blade member planar portion 20 is adapted for insertion between a panel and a mounting surface, with one of the blade V-shaped notches 40 engaging a panel fastener. The opposed edges 35 and square end 65 of the blade portion 20 each has a beveled surface 60 that facilitates insertion of the blade planar portion 20 between the panel and mounting surface, as well as positioning a panel fastener in the V-shaped notch 40 of the blade planar portion 20. The user contacts the fastener behind the panel with a beveled blade edge 35, then adjusts the tool 10 until the fastener is positioned in one of the V-shaped notches 40. The edges of the V-shaped notch 40 are not beveled, thereby providing close contact between the fastener and the blade planar portion 20. With the fastener positioned in the V-shaped notch 40, the user grasps the handle portion 50 and pivots the blade member 15 on an opposed edge 35, opposite the V-shaped notch 40 engaging the panel fastener, and thereby frees the fastener from the support surface.

Figure 6:
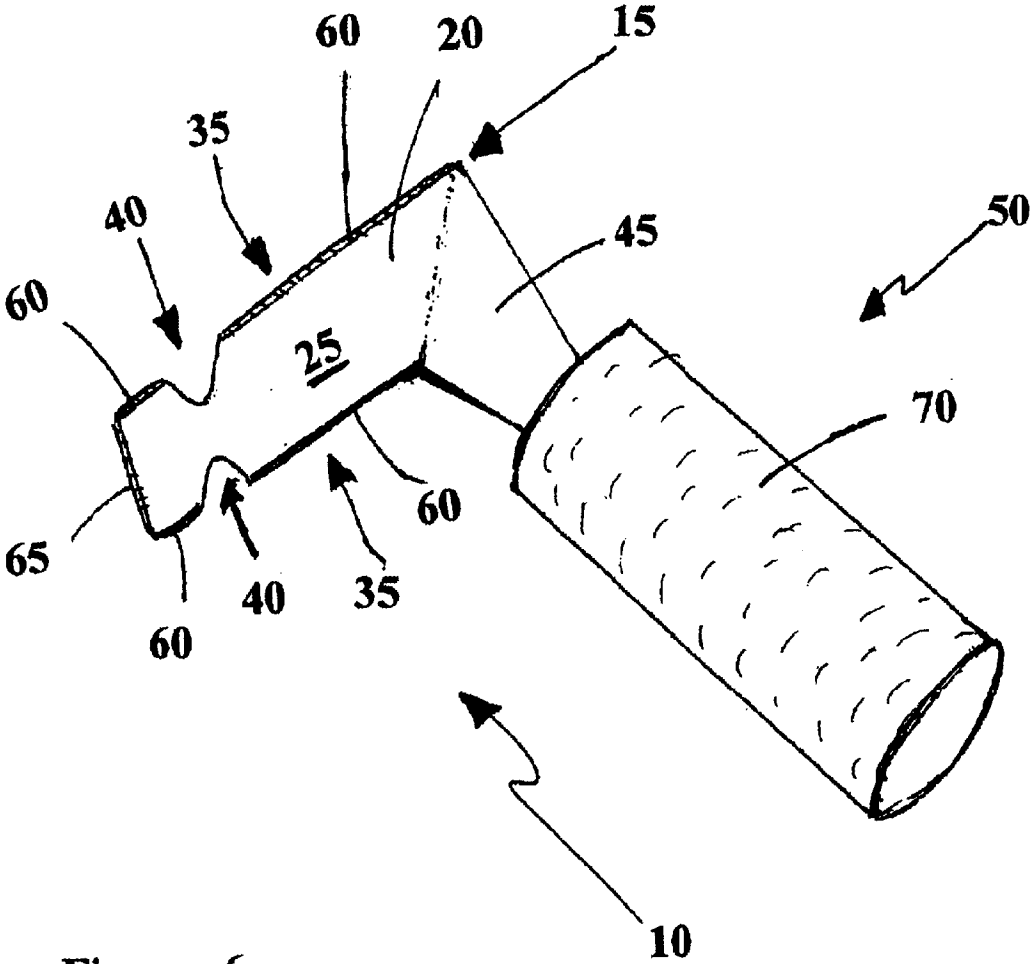
FIG. 6 is a perspective elevational view of another embodiment of the panel tool of the present invention.

Referring to FIG. 6, yet another embodiment of the panel removal tool 10 of the present invention is shown. The tool 10 comprises a linear blade member 15, having a planar blade portion 20 with a top surface 25 and a bottom surface 30 and opposed, parallel blade edges 35. Each opposed blade edge 35 includes a V-shaped notch 40. Preferably, the V-shaped notches 40 are directly opposed to each other and adjacent one end of the blade member 15. The blade member 15 includes an angled blade portion 45 disposed at between 90 and 150 degrees to the linear, planar blade portion 20. This embodiment provides an angle of 90 degrees between the planar blade portion 20 and the angled blade portion 45. A handle portion 50 is collinearly secured to the blade member angled portion 45. The embodiment of the tool 10 of FIG. 6 includes a cylindrical handle portion 70 that is secured at one end to the angled blade portion 45, which tapers from the planar blade portion 20 to the connection with the cylindrical handle portion 70.

In a further embodiment of the panel removal tool 10 of the present invention, the opposed edges 35 and square end 65 of the planar blade portion 20 each has a beveled surface 60 from the top surface 25 to the bottom surface 30, where the top surface 25 is adjacent the handle portion 50 and the bottom surface is opposite the handle portion 50. The edges of the V-shaped notches 40, most preferably, are not beveled, but are vertical.

The blade member planar portion 20 is adapted for insertion between a panel and a mounting surface, with one of the blade V-shaped notches 40 engaging a panel fastener. The opposed edges 35 and square end 65 of the blade portion 20 each has a beveled surface 60 that facilitates insertion of the blade planar portion 20 between the panel and mounting surface, as well as positioning a panel fastener in the V-shaped notch 40 of the blade planar portion 20. The user contacts the fastener behind the panel with a beveled blade edge 35, then adjusts the tool 10 until the fastener is positioned in one of the V-shaped notches 40. The edges of the V-shaped notch 40 are not beveled, thereby providing close contact between the fastener and the blade planar portion 20. With the fastener positioned in the V-shaped notch 40, the user grasps the handle portion 50 and pivots the blade member 15 on an opposed edge 35, opposite the V-shaped notch 40 engaging the panel fastener, and thereby frees the fastener from the support surface.

While the invention has been particularly shown and described with reference to preferred embodiments thereof, it will be understood by those skilled in the art that various changes in form and details may be made therein without departing from the spirit and scope of the invention.

I claim:

1. A panel removal tool for disconnecting a panel from a mounting surface, the tool comprising:

(a) a blade member having a planar portion with top and bottom surfaces and opposed, parallel edges, each opposed edge including a V-shaped notch, the blade member including an angled portion disposed at between 90 and 150 degrees to the planar portion; and (b) a handle portion collinearly secured to the blade member angled portion, the handle portion including a planar, flat member rolled edges, the blade member planar portion adapted for insertion between a panel and a mounting surface, with one blade V-shaped notch engaging a panel fastener, whereby pivoting the blade member on an opposed, parallel edge opposite the V-shaped notch engaging the panel fastener, thereby frees the fastener from the support surface.

2. The panel removal tool for disconnecting a panel from a mounting surface according to claim 1, wherein the V-shaped notches are opposed to each other.

3. The panel removal tool for disconnecting a panel from a mounting surface according to claim 1, wherein the blade portion includes edges beveled from the blade top surface to the blade bottom surface.

4. The panel removal tool for disconnecting a panel from a mounting surface according to claim 1, wherein the V-shaped notches include vertical edges.

5. The panel removal tool for disconnecting a panel for a amounting surface according to claim 1, wherein the blade angled portion and the handle portion form a continuous, unitary structure.

6. The panel removal tool for disconnecting a panel from a mounting surface according to claim 1, wherein the blade angled portion is disposed at 90 degrees to the blade penny portion.

7. The panel removal tool for disconnecting a panel from a mounting surface, according to claim 1, wherein the blade planar portion, the blade angled portion and the handle portion are fabricated from steel alloy sheet metal.

8. A panel removal tool for disconnecting a panel from a mounting surface, the tool comprising;

(a) a blade member having a planar portion width top and bottom surfaces and opposed, parallel edges, each opposed edge including a V-shaped notch, the blade member planar portion including edges beveled from the blade top surface to the blade bottom surface, the blade member including an angled portion disposed at between 90 and 150 degrees to the planar portion; and (b) a handle portion collinearly secured to the blade member angled portion, the blade member planar portion adapted for insertion between a panel and a mounting surface, with one blade V-shaped notch engaging a panel fastener whereby pivoting the blade member on an opposed, parallel edge opposite the V-shaped notch engaging the panel fastener, thereby frees the fastener from the support surface.

9. The panel removal tool for disconnecting a panel from a mounting surface according to claim 8, wherein the V-shaped notches are opposed to each other.

10. The panel removal tool for disconnecting a panel from a mounting disc according to claim 8, wherein the V-shaped notches include vertical edges.

11. The panel removal tool for disconnecting a panel from a mounting surface according to claim 8, wherein the blade angled portion and the handle portion form a continuous, unitary structure.

12. The panel removal tool for disconnecting a panel from a mounting source according to claim 8, wherein the handle portion includes a planar, flat member with rolled edges.

13. The panel removal tool for disconnecting a panel from a mounting surface according to claim 8, wherein the handle portion is a cylindrical member.

14. The panel removal tool for disconnecting a panel from a mounting surface according to claim 8, wherein the blade angled portion is disposed at 90 degrees to the blade planar portion.

15. The panel removal tool for disconnecting a panel from a mounting surface according to claim 8, wherein the blade planar portion, the blade angled portion and the handle portion are fabricated from steel alloy sheet metal.

16. A panel removal tool for disconnecting a panel from a mounting surface, the tool comprising;

(a) a blade member having a planar portion with top and bottom surfaces and opposed, parallel edges, each opposed edge including an opposed V-shaped notch with vertical edges, the blade member planar portion including edges beveled from the blade top surface to the blade bottom surface, the blade member including an angled portion disposed at 90 degrees to the planar portion; and (b) a handle portion collinearly secured to the blade member angled portion, the blade member planar portion adapted for insertion between a panel and a mounting surface, with one blade V-shaped notch engaging a panel fastener, whereby pivoting the blade member on an opposed parallel edge opposite the V-shaped notch engaging the panel fastener, thereby frees the fastener from the support surface.

17. The panel removal tool for disconnecting a panel from a mounting surface according to claim 16, wherein the blade angled portion and the handle portion from a continuous, unitary structure.

18. The panel removal tool for disconnecting a panel from a mounting surface according to claim 16, wherein the blade planar portion, the blade angled portion and the handle portion are fabricated from steel alloy sheet metal.

* * * * *